US006644906B2

(12) United States Patent
Bayne

(10) Patent No.: US 6,644,906 B2
(45) Date of Patent: Nov. 11, 2003

(54) SELF-ADAPTING REFUSE RECEPTACLE LIFT WITH LOW PROFILE

(75) Inventor: Jimmy O. Bayne, Anderson, SC (US)

(73) Assignee: Bayne Machine Works, Inc., Greenville, SC (US)

( * ) Notice: Subject to any disclaimer, the term of this patent is extended or adjusted under 35 U.S.C. 154(b) by 0 days.

(21) Appl. No.: 09/774,252

(22) Filed: Jan. 30, 2001

(65) Prior Publication Data

US 2001/0046430 A1 Nov. 29, 2001

Related U.S. Application Data

(60) Provisional application No. 60/179,233, filed on Jan. 31, 2000.

(51) Int. Cl.[7] ..... B65F 3/04
(52) U.S. Cl. ..... 414/408; 414/403
(58) Field of Search ..... 414/408, 409, 414/406, 303, 420, 403; 901/31

(56) References Cited

U.S. PATENT DOCUMENTS

| | | | | |
|---|---|---|---|---|
| 3,762,586 A | | 10/1973 | Updike, Jr. | |
| 3,804,277 A | | 4/1974 | Brown et al. | |
| 3,894,642 A | | 7/1975 | Shive | |
| 4,219,298 A | * | 8/1980 | Stragier et al. | 414/409 |
| 4,479,751 A | | 10/1984 | Wyman et al. | |
| 4,543,028 A | * | 9/1985 | Bell et al. | 414/408 |
| 4,773,812 A | * | 9/1988 | Bayne et al. | 414/408 |
| 5,020,844 A | * | 6/1991 | Pickrell | 294/86.4 |
| 5,222,853 A | * | 6/1993 | Carson | 414/408 |
| 5,308,211 A | | 5/1994 | Bayne | |
| 5,333,984 A | | 8/1994 | Bayne et al. | |
| 5,398,983 A | * | 3/1995 | Ahrens | 294/106 |
| 5,562,386 A | * | 10/1996 | Browning | 414/406 |
| 5,711,565 A | * | 1/1998 | Smith et al. | 294/106 |

FOREIGN PATENT DOCUMENTS

| | | |
|---|---|---|
| DE | 2228503 | 1/1974 |
| EP | 0405345 A1 | 1/1991 |
| FR | 2459768 | 1/1981 |
| FR | 2479783 | 10/1981 |

OTHER PUBLICATIONS

EPO Search Report; May 22, 2000; Application No. EP 00 20 0062.

* cited by examiner

*Primary Examiner*—Eileen D. Lillis
*Assistant Examiner*—Charles A Fox
(74) *Attorney, Agent, or Firm*—McAndrews, Held & Malloy, Ltd.

(57) ABSTRACT

A self-adapting refuse receptacle lift has a carriage for raising and dumping the contents of a refuse receptacle into a collection load box or refuse gathering vehicle. The carriage is carried on extending arms, the rotation of which may be controlled with a hydraulic or other powered drive device. The carriage includes attachments comprising a pair of moveable clamp arms. The clamp arms have self-adapting features so that a variety of receptacles of different sizes and shapes may be lifted by the apparatus. Sequencing elements rotate the clamp arms down from a vertical stored position into a horizontal position for clamping a receptacle to be dumped. Then, the entire carriage is raised for inverting and dumping and the contents of the receptacle, and then reverse operations follow, whereby the clamp arms return to an upright stored vertical position to be out of the way during the movement of a refuse collecting vehicle.

13 Claims, 12 Drawing Sheets

SELF-ADAPTING REFUSE RECEPTACLE LIFT WITH LOW PROFILE

CROSS-REFERENCE TO RELATED APPLICATIONS

This application claims priority from and is related to provisional application, serial No. 60/179,233 filed Jan. 31, 2000.

FIELD OF THE INVENTION

The present invention relates to refuse receptacle lifts for use with a refuse collection load box or a refuse gathering vehicle. More specifically, the present invention relates to a low or slim profile self-adapting apparatus, i.e., that is capable of lifting refuse receptacles of varying sizes and shapes using a self-adapting clamp arm and then dumping the contents of the refuse receptacle into a load box or other refuse container.

BACKGROUND OF THE INVENTION

Receptacles for the receipt, temporary storage, and/or transport of refuse are available in a variety of shapes and sizes. While the traditional, round metal garbage can is still utilized, many have been replaced with generally larger and lighter receptacles constructed from various plastics and other synthetic materials. Features may include for example hinged covers, locking covers, wheels, and handles in various locations and configurations. Capacities may range for example from 30 gallons to 95 gallons.

Typically, on the day of collection, the receptacle is placed near curb-side for pick-up involving a gathering vehicle. The refuse collected in such conventional receptacles from residences and businesses must be then transported usually by a commercial or municipal service to a treatment or disposal site. Generally, a refuse gathering vehicle equipped with a compactor is used to transport the contents of the receptacle from curb side to such a later site. Consequently, the receptacle's contents must be conveyed to a designated compartment on the gathering vehicle. Current conventional containers can weigh as much as 200 pounds when loaded. Various receptacle dumping mechanisms exist for delivering a receptacle's contents into the compartment of a gathering vehicle. For example, dumping mechanisms that include a movable carriage configured to receive a receptacle and dump its contents into a gathering vehicle are described in Brown et al. (U.S. Pat. No. 3,804,277), Shive (U.S. Pat. No. 3,894,642), and Wyman et al. (U.S. Pat. No. 4,479,751). The disclosures of such patents are incorporated herein by reference.

While such types of lift devices and associated receptacles generally permit mechanized dumping (as opposed to manual), various drawbacks and inefficiencies persist. For example, some of such prior art receptacle dumping mechanisms typically may tend to dump the contents of the receptacle only near the very back of the refuse-receiving opening of the garbage truck. A typical garbage truck has a large opening located at its rear to provide access to a relatively large trash container carried on the truck. A dumping apparatus as discussed above is usually mounted adjacent such opening, such as at or on a rear bumper of a truck. A built-in trash compactor is also typically present in the container for compacting refuse therein. If the contents of the receptacle are dumped only at the very back of such refuse-receiving opening (as is often the case), a compaction cycle (i.e. operation of the built-in compactor of the garbage truck) must be run after almost each successive receptacle dumping so as to push the dumped contents forward, i.e. away from the very rear of the garbage truck, to make room for the next dumping. Having to frequently repeat compacting cycles is very time consuming, since a garbage truck normally would include a great number of stops at relatively short intervals on its route, and also adds to wear and tear on the compactor equipment.

Another drawback of some of such prior art mechanized dumping devices is the sheer size of the unit itself. Many prior art dumping devices have a width (i.e. projection from the rear bumper of the garbage truck) in a range of about 16 to 20 inches, not including the trash receptacle mounted for dumping. A safety hazard is thus presented by structure which projects substantially from the rear of the vehicle, particularly since it cannot be seen by the driver of the truck.

Also, as an additional practical matter, garbage trucks outfitted with such prior art (relatively thick) dumping apparatuses for smaller residential trash receptacles cannot be simultaneously used for dumping larger commercial trash dumpsters. Such dumpsters are normally pivoted against pivot members mounted at the rear of the truck itself while being winched upward with a powered cable mounted at the top of the garbage truck. Such dual use of a garbage truck is normally not possible with the typical prior art residential receptacle dumping device because there is not sufficient clearance for the commercial dumpster to be pivoted on the truck-mounted pivot members around the prior art residential dumping devices due to their relatively thick width.

Additionally, some refuse-gathering vehicles have their refuse-receiving openings on the sides of the truck, rather than at their backs. Such side-loading vehicles typically cannot safely use such prior art dumping devices again because they generally extend too far from the side of the truck.

Commonly owned U.S. Pat. No. 4,773,812 discloses a receptacle lift and slim profile power unit addressing certain of the disadvantages of typical receptacle dumping apparatuses referenced above. The width of such a lift is substantially less than typical receptacle dumping apparatuses and includes a power drive unit that is also of reduced width. Such reduced profile allows such lift configuration to be used in conjunction with existing refuse gathering vehicles to overcome problems with the typical receptacle lifts above discussed. Such lift may also be used to dump receptacle contents a predetermined distance up into a refuse gathering vehicle so that the vehicle's compactor unit does not require operation after each dumping cycle. It may also be installed on a gathering vehicle so as not to interfere with the lift mechanisms that may already be present on a gathering vehicle for dumping other types of containers such as larger bins typically not used for residential, curb-side pick-up. The disclosure of U.S. Pat. No. 4,773,812 is incorporated herein by reference.

Due to the various unique geometries of the receptacles available and in use, typical prior art lifts may not be functional with all receptacle types currently encountered during a refuse pick-up. For example, the handles on various receptacles may be located at different heights, have different shapes, and be positioned at different orientations on a receptacle. The height, width, and overall volume of each receptacle may vary widely. Commonly owned U.S. Pat. Nos. 5,308,211 and 5,333,984 disclose various receptacle types and certain lifter variations. The disclosures of all such patents are hereby incorporated herein by reference. The container may be structured for dumping by a correspondingly configured lift. Similarly, the lift in place on a particular gathering vehicle may only be configured to receive a receptacle meeting the particular specifications of that lift. While generally uniform receptacles on any given pick-up route could be used to ensure the functionality of the lift with all receptacles encountered by the gathering vehicle, such a requirement may not be practical. Even though existing prior art lifts may be modifiable for a given receptacle type, a lift capable of adapting automatically to a variety of container types without prior modification and while in use during a refuse pick-up route would provide additional benefits over existing apparatuses. Such a lift that also incorporates the features of U.S. Pat. No. 4,773,812, so as to overcome the limitations of the typical receptacle lift as above identified would be even more desirable.

SUMMARY OF THE INVENTION

The present invention provides an adaptable, refuse receptacle lift for use with a refuse collection load box or a refuse gathering vehicle. A unique self-adapting clamp arm is used to provide a lift that automatically self-adapts to the size and shape of a variety of receptacles while the lift is in use and without requiring prior modifications each time a different receptacle type is encountered. By incorporating features disclosed in U.S. Pat. No. 4,773,812, the present invention also provides a lift that overcomes problems associated with typical receptacle lifts as above identified. By way of example, the present lift is of a reduced profile and is also capable of dumping a receptacle's contents a predetermined distance up into a refuse gathering vehicle so that the vehicle's compactor unit does not require operation after each dumping cycle.

In addition, the present invention relates to certain sequencing features, so that self-adapting clamp arm features are also operated for maximum clearance during non-use, for safer vehicle movement and operation.

Additional objects and advantages of the invention are set forth in, or will be apparent to those of ordinary skill in the art from the detailed description herein. Also, it should be further appreciated that modifications and variations to the specifically illustrated and discussed features or materials hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts, features or the like.

Still further, it is to be understood that different embodiments, as well as different presently preferred embodiments, of this invention, may include various combinations or configurations of presently disclosed features or elements, or their equivalents (including combinations or configurations thereof not expressly shown in the figures or stated in the detailed description).

While various power drive units and lifting apparatuses embodying different combinations of presently disclosed features may be constructed, applying the teachings disclosed herein, to arrive at various embodiments of the present invention, one exemplary lift apparatus of the present invention includes:

a support frame adapted to be mounted onto a container;

a hydraulic actuator, attached to the support frame, having a rotatable output shaft, and configured for controllably positioning the rotary orientation of such output shaft;

a carriage adapted for supporting a receptacle, such carriage being pivotally supported relative to the support frame;

a pair of idler arms for pivotally supporting such carriage relative to the support frame;

a pair of torque arms for pivotally supporting such carriage relative to the output shaft;

a clamp arm shaft attached to such carriage and rotatable relative to the carriage;

a pair of self-adapting clamp arms, each clamp arm having a receptacle receiving end and a non-receptacle receiving end, each clamp arm being pivotally connected near the non-receptacle receiving end to the rotatable clamp arm shaft, whereby the such clamp arms may be controllably rotated relative to the carriage, each clamp arm being configured to adapt to the size and shape of a variety of receptacles for lifting by the apparatus;

a first hydraulic drive attached to the carriage, having a reciprocating shaft pivotally connected to the rotatable clamp arm shaft, such first hydraulic drive controllably positioning the rotary orientation of the clamp arm shaft;

a second hydraulic drive pivotally connected to the non-receptacle receiving end of the pair of self-adapting clamp arms, whereby such clamp arms may be controllably opened and closed;

wherein the hydraulic actuator, the first hydraulic drive, and the second hydraulic drive are controllably operated, and in a desired, predetermined sequence, so as to cause controlled rotation of the self-adapting clamp arms between an upright stored position and a position for the receipt of a receptacle, causes controlled opening and closing of the self-adapting clamp arms for securing a receptacle; and causes controlled pivoting of the carriage on respective ends of the idler arms and torque arms, between a lowered, upright position of the carriage for receiving a receptacle and a relatively raised, inverted position of the carriage for emptying the contents of a receptacle.

Another exemplary embodiment of a receptacle lift apparatus in accordance with the present invention, includes:

a base adapted for mounting the lift onto a container;

a first power means, attached to such base, having a rotatable output shaft, such first power means controllably positioning the rotary orientation of such output shaft;

a carriage pivotally supported relative to the base;

dual paired projection arm means, pivotally associated with the base and the output shaft, respectively, for supporting and selectively positioning the carriage during the lifting and conveying of a receptacle, and configured so as to dump the contents of a receptacle received by the lift;

a positioning shaft, connected to the carriage and rotatable relative to the carriage;

an adaptable embracing means for receipt of a receptacle, pivotally connected to the positioning shaft such that the rotary orientation of the embracing means may be controlled by the positioning shaft, and adaptable to the size and shape of a receptacle to be lifted;

a support means, connected to the positioning shaft, for providing support to a receptacle received by the lift;

a second power means, attached to the carriage, and pivotally attached to the positioning shaft, whereby such second power means may control the rotary orientation of the positioning shaft;

a third power means, connected to the adaptable embracing means and controllably pivoting the embracing means about the positioning shaft such that a receptacle may be controllably embraced;

wherein selective operation of the first, second, and third power means causes in desired sequence controlled rotation of the adaptable embracing means, causes controllable embracing of a receptacle by the embracing means, and causes controlled movement of the carriage on the dual paired projection arm means relative to the base between a lowered position of the embracing means for receipt of a receptacle and a relatively raised, and inverted position for the emptying of any contents within the receptacle.

Still another example of a receptacle lift in accordance with the present invention, for lifting and dumping the contents of a receptacle into a container, includes:

a mainframe having a first side and a second side, such first side being adapted for attachment to the container;

a motor, attached to the second side of the mainframe, having a rotatable output shaft, and configured for controllably positioning the rotary orientation of such output shaft;

a plate pivotally connected to the second side of the mainframe;

a first pair of arms, pivotally connected to the second side of the mainframe and pivotally connected to the plate;

a second pair of arms, fixedly connected to the rotatable output shaft and pivotally connected to the plate;

a clamp arm shaft secured to the plate and rotatable relative to the plate;

a least one clamp arm, such clamp arm including an arcuate support member having a first end and a second end, such support member pivotally connected near the first end to the clamp arm shaft such that the rotary orientation of such clamp arm may be controlled by the clamp arm shaft, such clamp arm also including a band of flexible material connected near the first end and near the second end of the support member arm and spanning in between such ends, whereby upon contacting a receptacle, such clamp arm may adapt to the size and shape of the receptacle for securing the receptacle during lifting and dumping of the receptacle;

a first hydraulic cylinder attached to the plate and pivotally attached to the clamp arm shaft and configured such that the extension and retraction of the hydraulic cylinder controls the rotary orientation of the clamp arm shaft;

a second hydraulic cylinder pivotally connected near the first end of the clamp arm and configured such that the extension and retraction of the hydraulic cylinder controls the pivoting of the clamp arm about the clamp arm shaft, whereby such clamp arm may be pressed against the receptacle to secure the receptacle to the lift;

wherein selected operation of the motor, the first hydraulic cylinder, and the second hydraulic cylinder causes in sequence the clamp arm to move into a position so as to secure a receptacle to the lift; and causes the lift to move the receptacle between a relatively lowered position and a relatively upright and inverted position where the contents may be dumped into the container.

These and other features, aspects and advantages of the present invention will become better understood with reference to the following description. The accompanying drawings, which are incorporated in and constitute a part of this specification, illustrate an embodiment of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
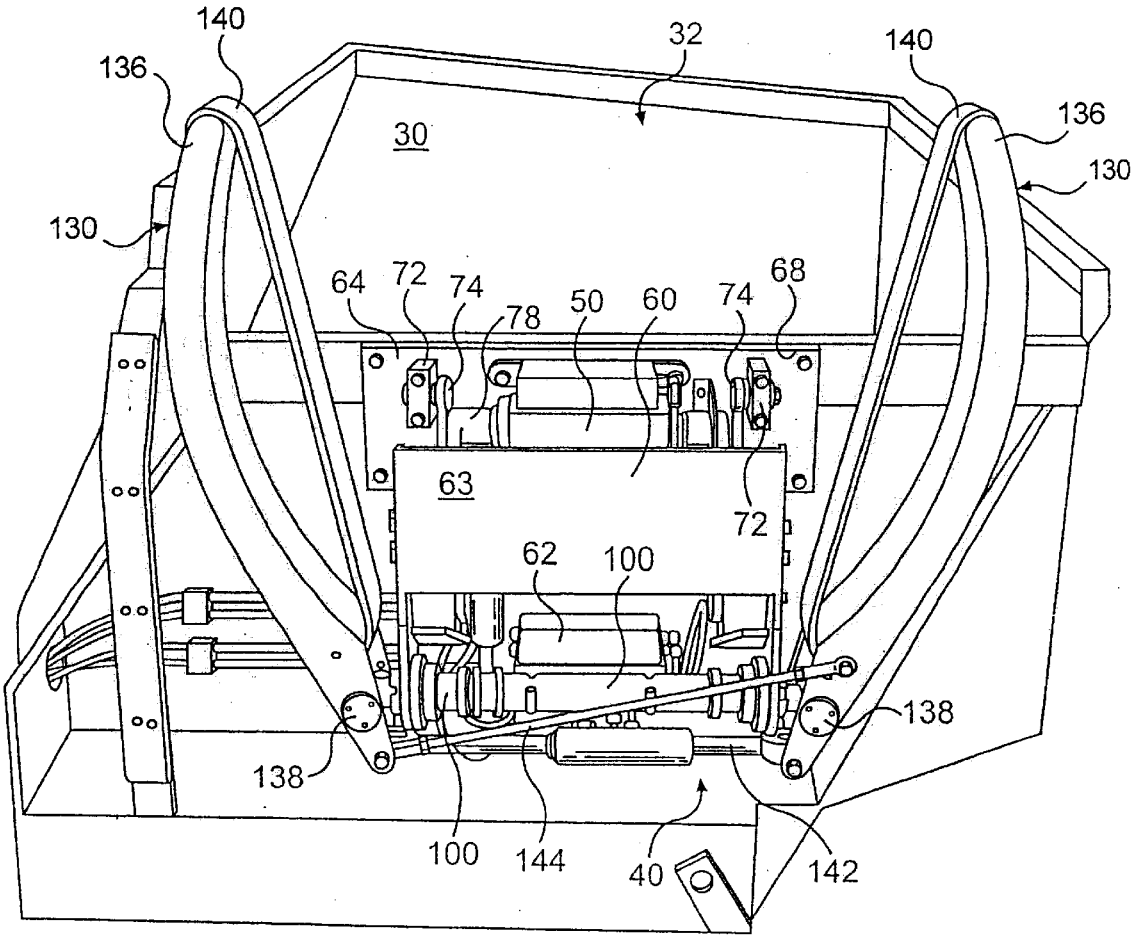
FIG. 1 is a perspective view of an exemplary self-adapting refuse receptacle lift in accordance with the present invention, in a retracted position mounted onto a container.

Repeat use of reference characters throughout the present specification and appended drawings is intended to represent same or analogous features or elements of the invention.

DETAILED DESCRIPTION OF THE PREFERRED EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on or with another embodiment to yield a still further embodiment. Thus, it is intended that the present invention cover such modifications and variations. Other objects, features and aspects of the present invention are disclosed in or are apparent from the following detailed description. It is to be understood by one of ordinary skill in the art that the present discussion is a description of exemplary embodiments only, and is not intended as limiting the broader aspects of the present invention.

FIG. 1 illustrates one embodiment of a self-adapting refuse receptacle lift 40 configured for use with an exemplary refuse container 30. Container 30 includes an opening 32 into which the contents of a receptacle may be dumped using receptacle lift 40. Container 30 may be used in conjunction with a refuse gathering vehicle as set forth, for example, in U.S. Pat. No. 5,308,211, which is incorporated herein be reference. Lift 40 is shown in the retracted position where it may be stored and where it assumes a relatively slim profile. FIG. 1 is but an example of one application of lift 40; the present invention may be used in a variety of other applications using the teachings disclosed herein.

Figure 2:
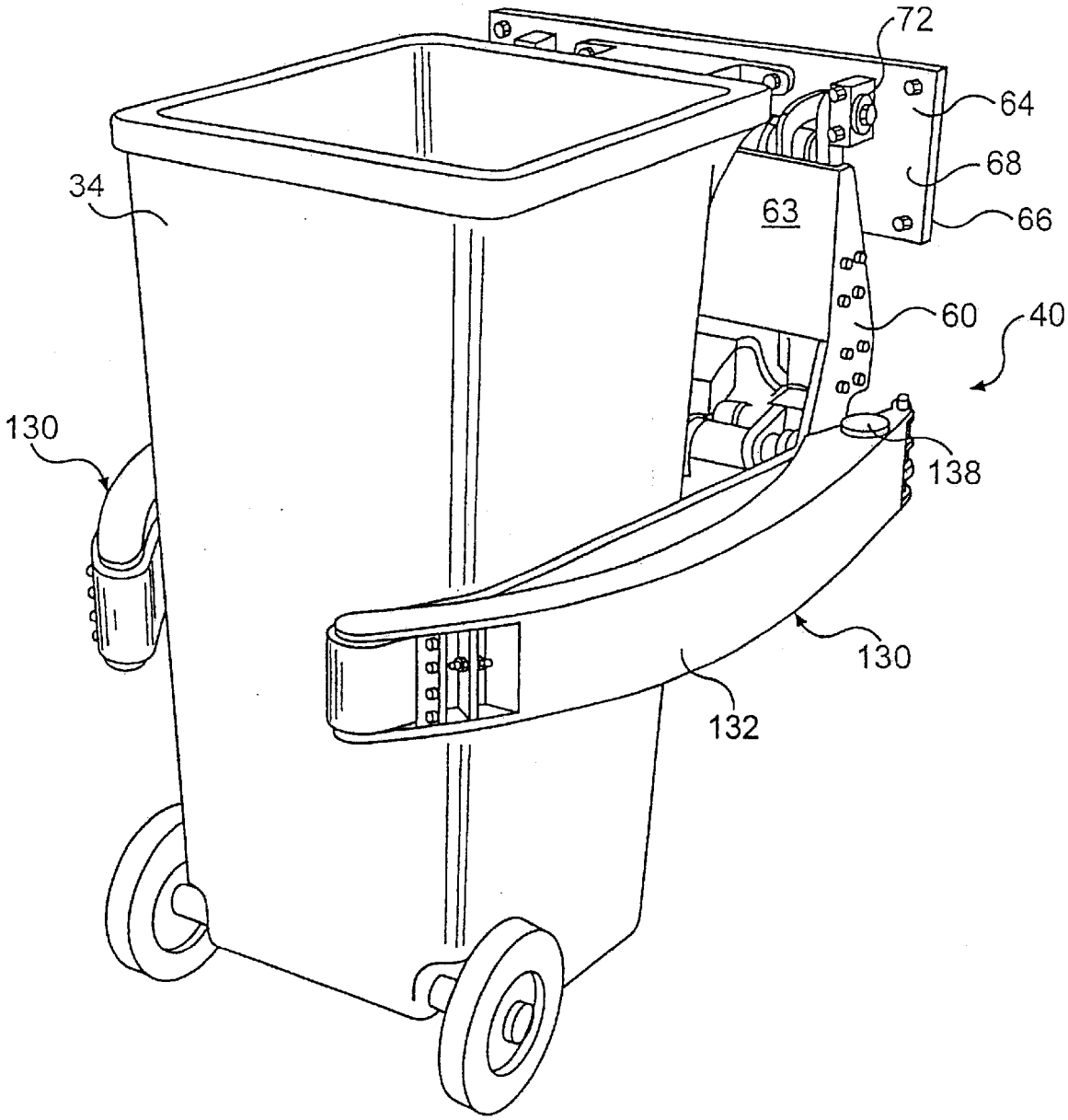
FIG. 2 is a perspective view of the self-adapting refuse receptacle lift of FIG. 1 embracing one example of a receptacle.

FIG. 2 shows lift 40 in isolation embracing an exemplary receptacle 34. Lift 40 and receptacle 34 are depicted in the position lift 40 and receptacle 34 occupy both at the point prior to lifting receptacle 34 and at the point after the contents of receptacle 34 have been dumped into container 30. FIG. 3 shows lift 40, again in isolation, embracing receptacle 34 in an inverted position in which contents from receptacle 34 may be dumped into container 30.

Referring now to FIGS. 1 thru 4, this particular embodiment of lift 40 includes a support frame 64 for mounting onto a surface, such as the side of container 30. Support frame 64 has two sides, a first side 66 and a second side 68. First side 66 is adapted to be secured, such as by welding or with bolts or the like, to container 30, a refuse-gathering vehicle, or other structure with which lift 40 is to be used. Other installations of lift 40, including those for other than the express use of lift 40 as a trash receptacle dumping device, come within the scope of the present invention.

Figure 3:
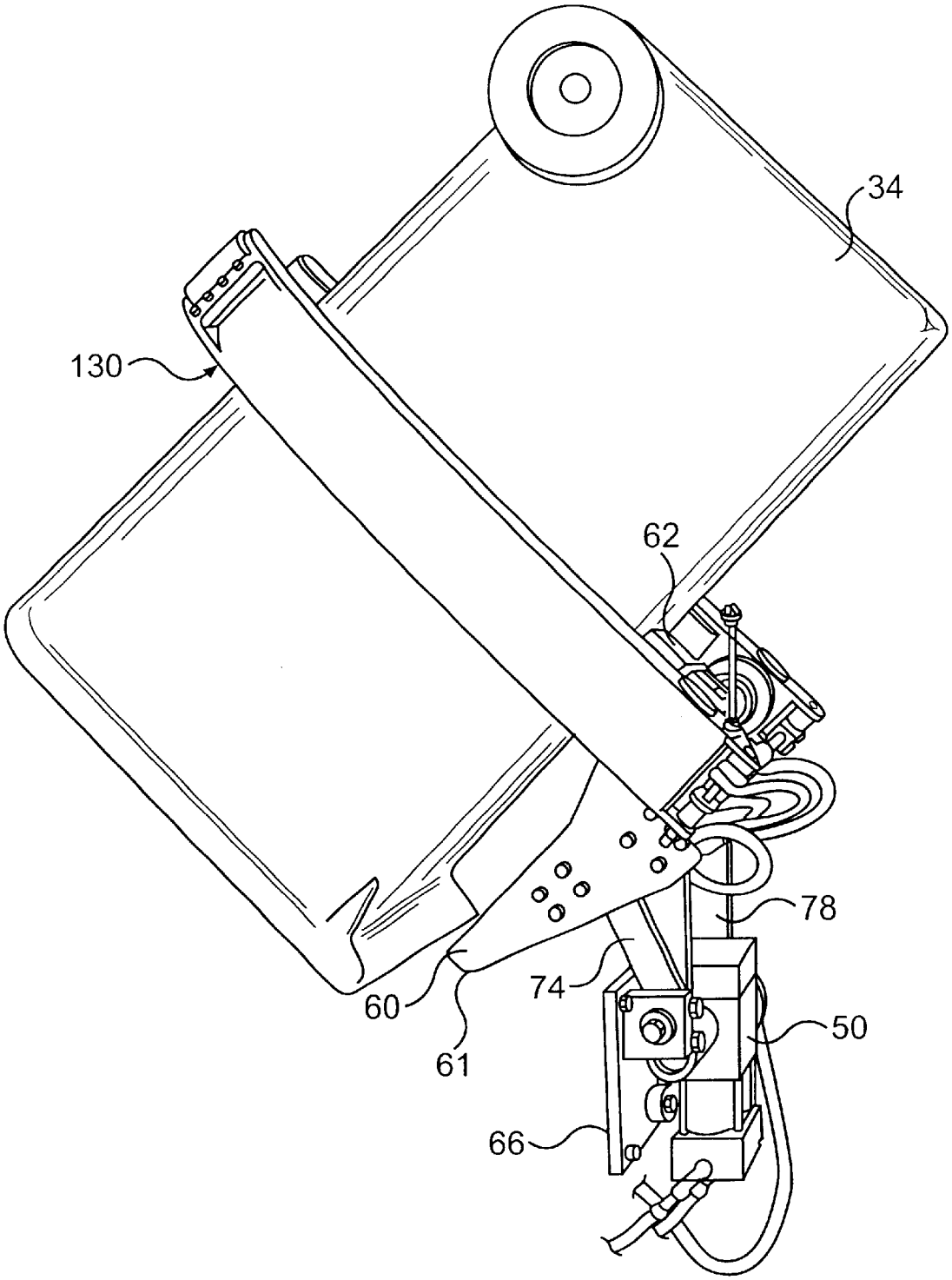
FIG. 3 is a perspective view of the self-adapting refuse receptacle lift of FIG. 1 embracing an exemplary receptacle in an inverted position.
Figure 4:
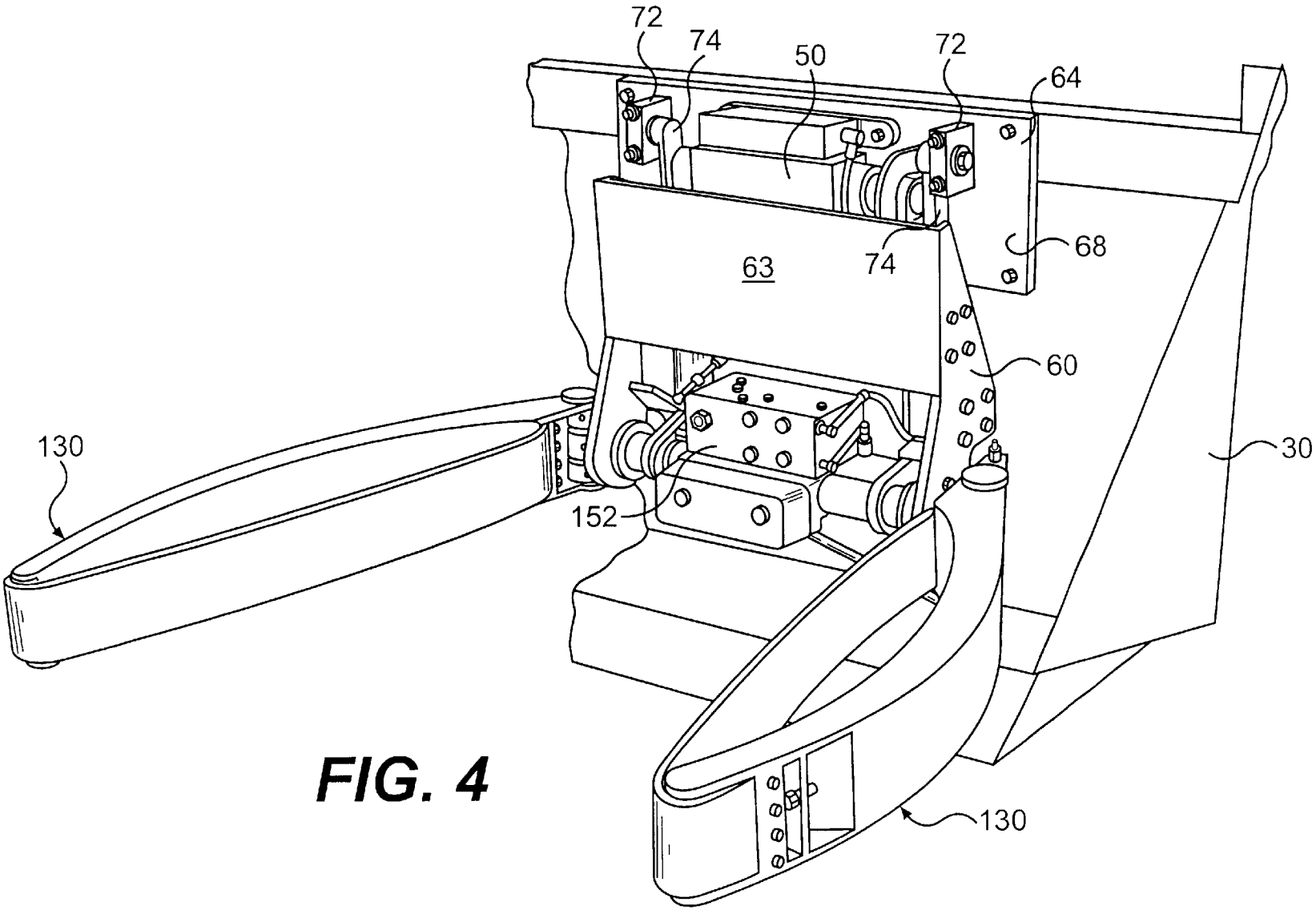
FIG. 4 is a perspective view of the self-adapting receptacle lift of FIG. 1 in isolation showing in enlargement the clamp arms in an extended position.

Second side 68 of support frame 64 supports an exemplary actuator 50 that is used to pivot the lift 40 between the relatively lowered position of FIG. 4 and the relatively raised and inverted position of FIG. 3, as more fully described below. In order to maintain the relatively slim profile of lift 40 in its retracted position (FIG. 1), low profile actuator 50 as depicted in FIG. 4 may be preferred. One such actuator that may be used in the present invention is disclosed in U.S. Pat. No. 4,773,812, the disclosure of which is incorporated herein by reference. In general, U.S. Pat. No. 4,773,812 describes a hydraulically-actuated, two cylinder, rack and pinion mechanism. An output shaft is passed through both cylinders and is rotated by the action of the cylinders. Accordingly, the selective operation of the cylinders may be used to control the rotary orientation of the output shaft of actuator 50. However, a variety of actuating mechanisms, including non-hydraulic, may be used to power the pivoting of lift 40, and this invention is not limited to a particular type or form of drive unit. Virtually any actuator 50 may be used provided the output shaft may be controllably rotated and configured to operate the lift as more fully discussed below.

Figure 5:
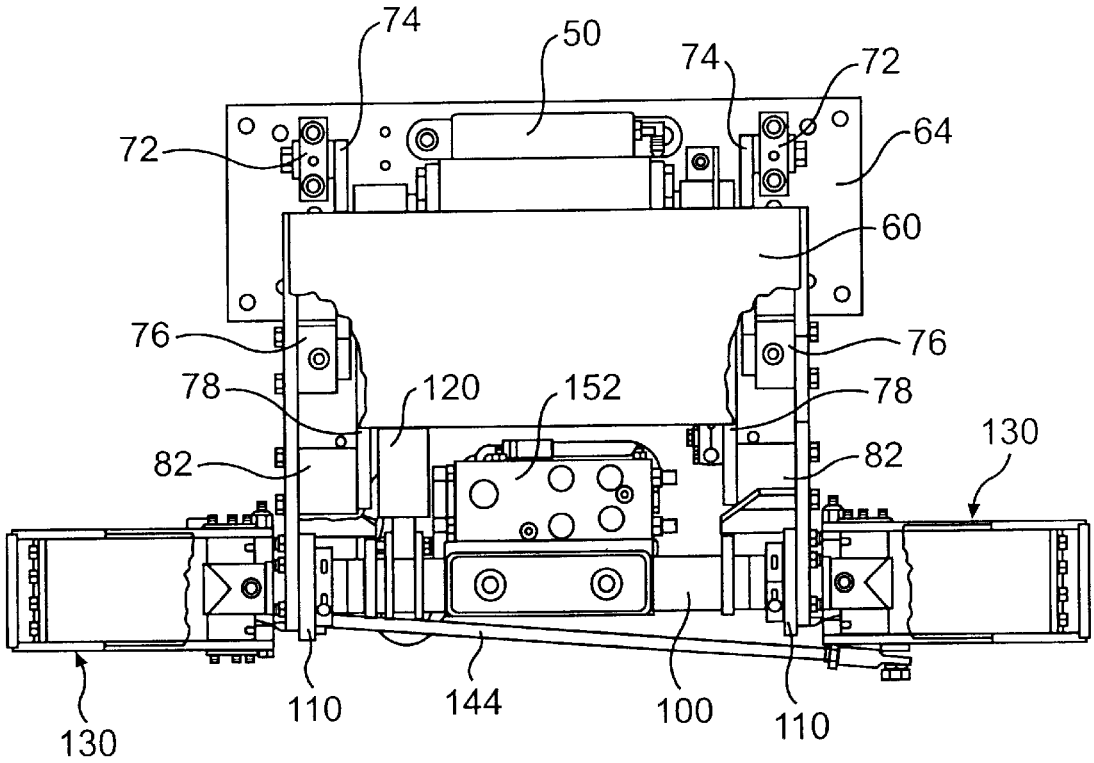
FIG. 5 is front, perspective and partial cut-away view of the self-adapting receptacle lift of FIG. 1 in enlargement.

A pair of pivot points 72 are also supported by the second side 68 of support frame 64. Pivot points 72 support a pair of idler arms 74 for pivotably supporting a carriage 60. FIG. 5 illustrates carriage 60 partially cutaway to permit illustration of the operative structure typically behind carriage 60. While it will be described in parts herein, this operative structure is also described in U.S. Pat. No. 4,773,812, which is incorporated herein by reference. Accordingly, idler arms 74 are also connected to the carriage 60 at a second pair of pivot points 76. The carriage 60 is therefore movable with respect to support frame 64 by pivoting upon arms 74.

Figure 5A:
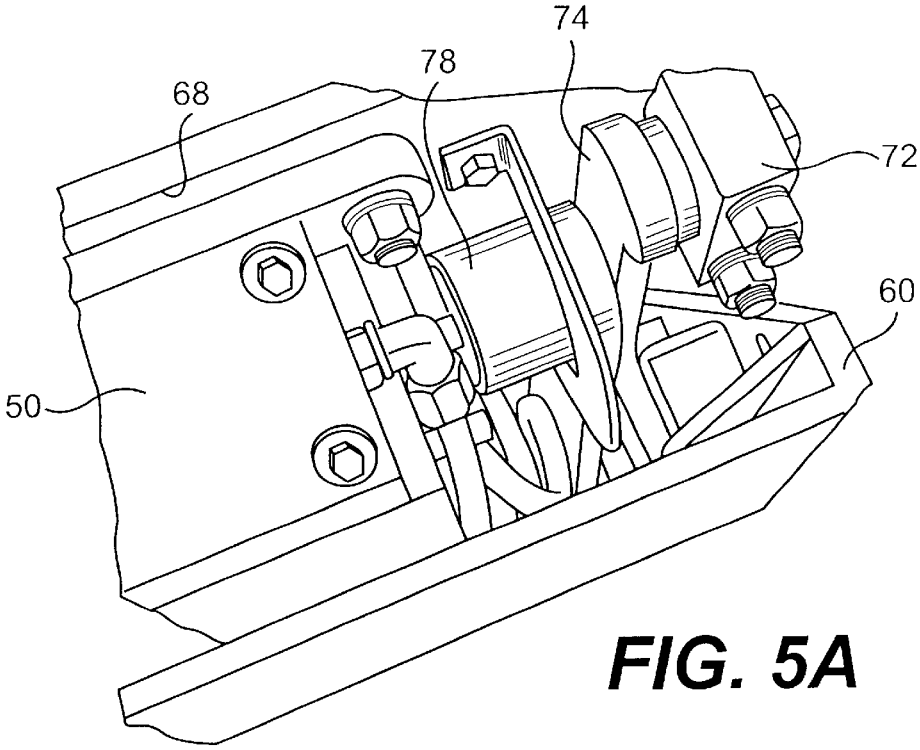
FIG. 5A is a top view in enlargement of the right corner of the self-adapting receptacle lift of FIG. 1.
Figure 5B:
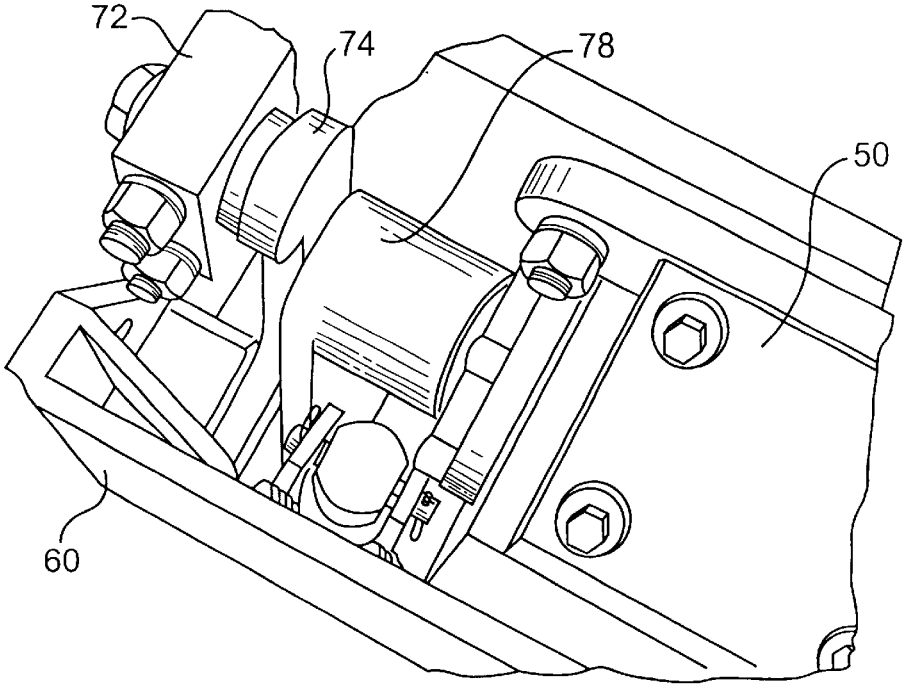
FIG. 5B is a top view in enlargement of the left corner of the self-adapting receptacle lift of FIG. 1.
Figure 8:
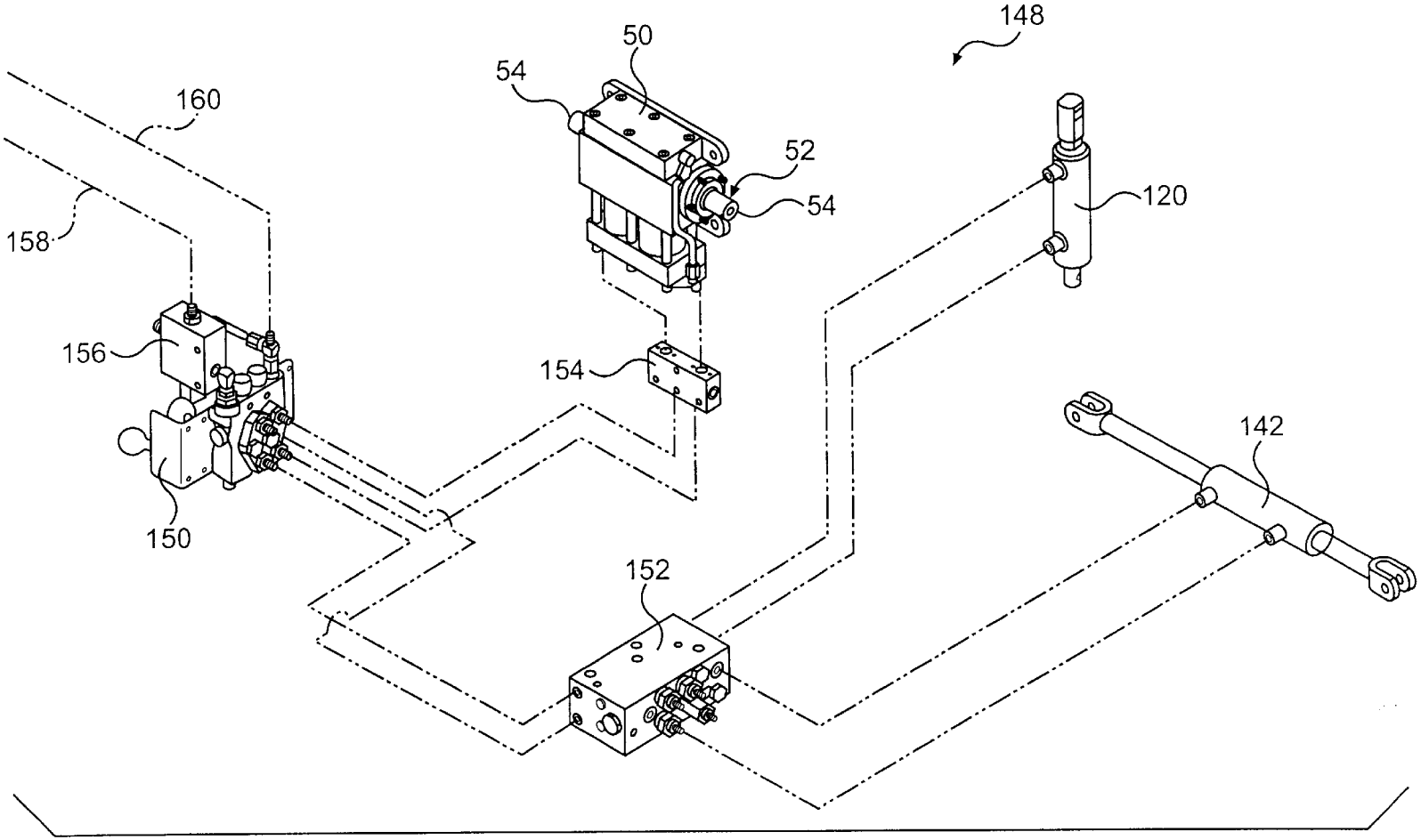
FIG. 8 is a partial schematic of an exemplary hydraulic control system for the present invention.

Carriage 60 is also connected to the output shaft of the actuator 50 through a pair of torque arms 78. A pair of pivot points 82 pivotably connect torque arms 78 to carriage 60. The other ends of torque arms 78 are fixedly connected to the output shaft of actuator 50. As shown in FIG. 8, the output shaft 52 of actuator 50 includes two respective ends 54 to which the ends of torque arms 78 may be respectively secured. FIGS. 5A and 5B provide further illustration of the connection of torque arms 78 and idler arms 74.

Figure 5C:
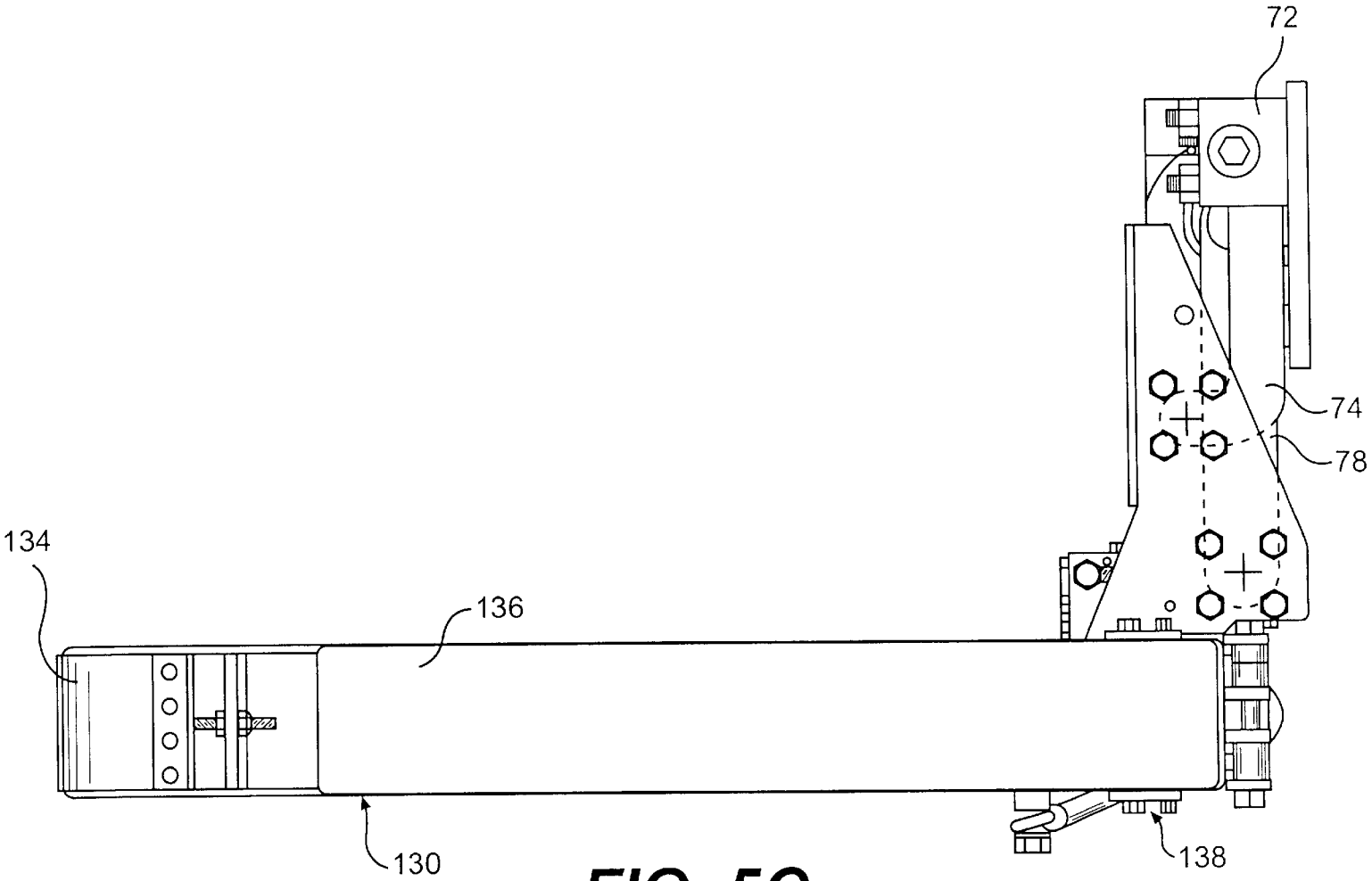
FIG. 5C is a plan view of the left side of the self-adapting receptacle lift of FIG. 1.
Figure 5D:
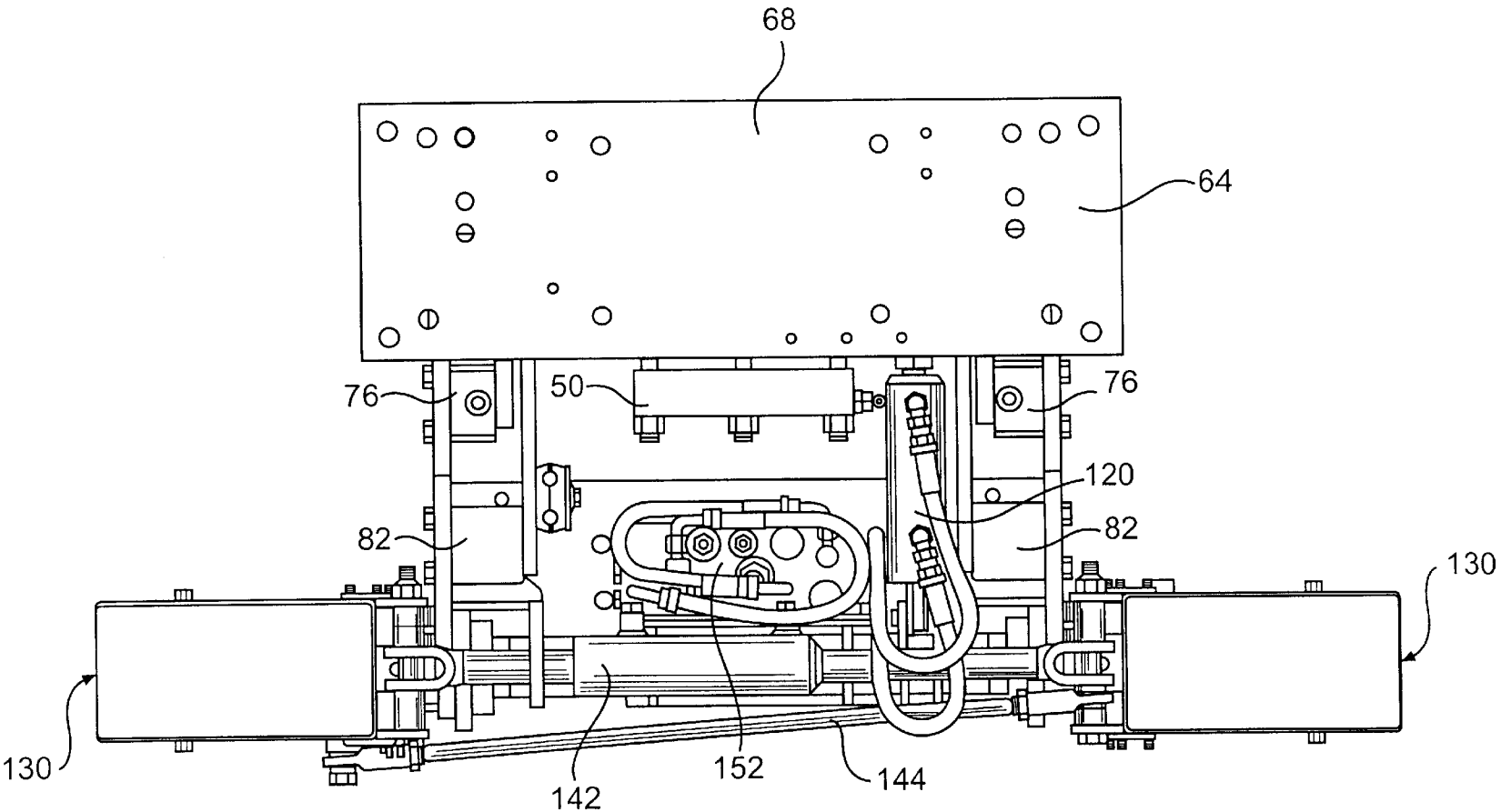
FIG. 5D is a plan view of the back side of the self-adapting receptacle lift of FIG. 1.

As shown in FIG. 5C, the respective lengths of idler arms 74 and torque arms 78, together with the displacement of the pivot points 72, pivot points 76, pivot points 82, and the fixed connection to output shaft 52, determines a distance which the front edge 51 (FIG. 3) of carriage 60 is projected behind the first side 66 of support frame 64 and, therefore, the distance receptacle 34 is projected when lift 40 is in its fully raised and inverted position. This lateral translation of receptacle 34 serves the useful purpose of projecting receptacle 34 a predetermined distance behind support frame 64. When the lift is connected to the receiving opening of a refuse gathering vehicle, this allows the contents of receptacle 34 to be dumped forwardly into the truck away from the very rear of the truck. As a result, the compaction unit of the truck may be advantageously operated less frequently, as was more fully discussed in the Background of the Invention. FIG. 5C presents a side view of the embodiment depicted in FIG. 5, illustrating the respective arm lengths and pivot point placements. FIG. 5D also provides a perspective view of the embodiment depicted in FIG. 5, taken from a view point opposite to that of FIG. 5.

Figure 6:
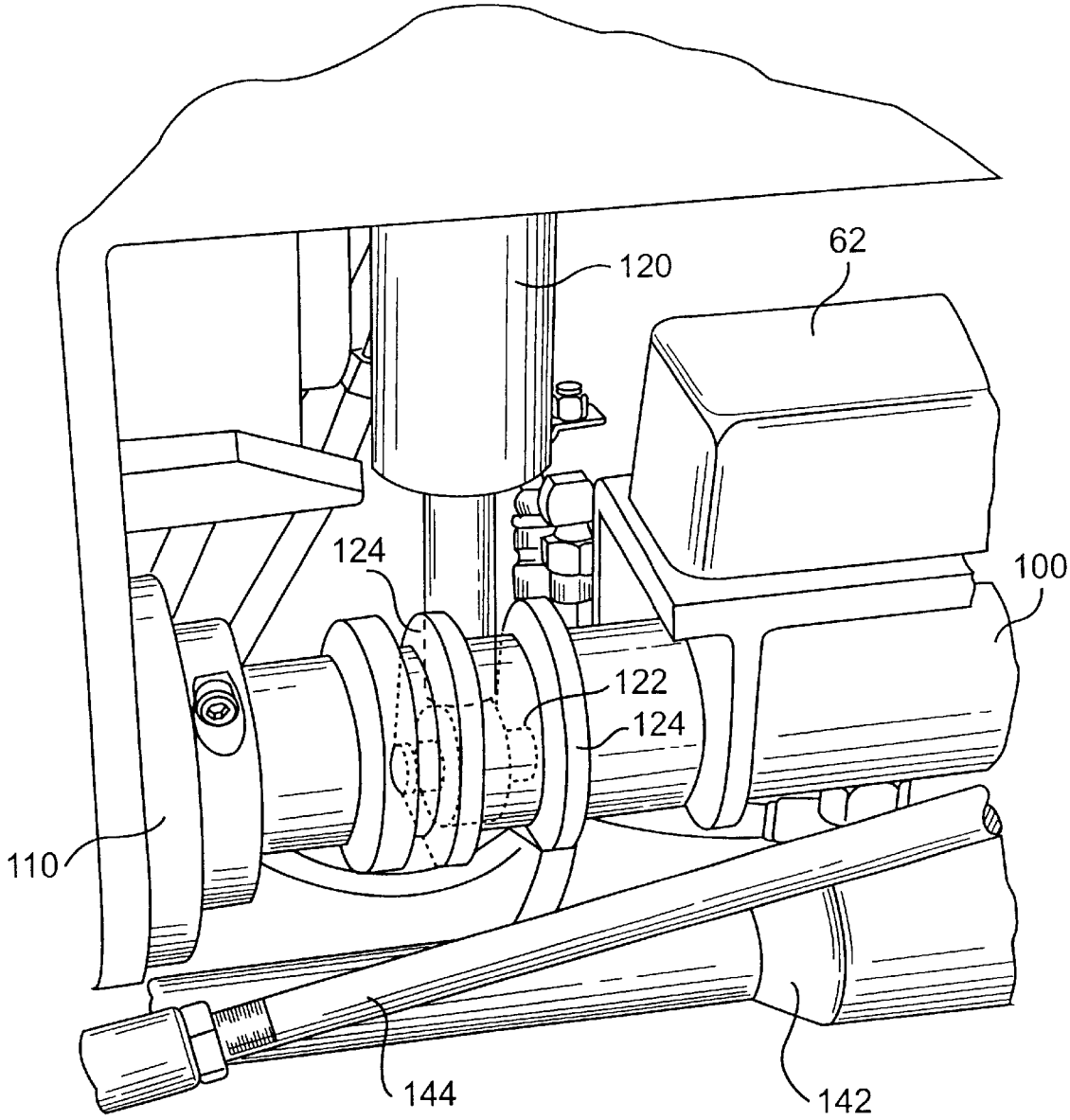
FIG. 6 is a front, perspective view in enlargement of the left and bottom corner of the self-adapting receptacle lift of FIG. 1.

Carriage 60 also supports a clamp arm shaft 100. The clamp arm shaft 100 is rotatable with respect to carriage 60 and is connected to the carriage 60 at rotatable points 110, which may be constructed from bearings inside bearing mounts or the like. Referring to FIG. 6, the clamp arm shaft 100 is controllably positioned using a first hydraulic cylinder 120 that is attached at one end to the carriage 60 and pivotably connected at the other end to clamp arm shaft 100. A locking pin 122 is used to pivotably connect first hydraulic cylinder 120 to a pair of lever flanges 124 integrally connected to the rotatable clamp arm shaft 100. Accordingly, selective extension and retraction of first hydraulic cylinder 120 allows the rotary orientation of shaft 100 to be controlled through changing the position of lever flanges 124 and thus the rotary orientation of shaft 100. While a hydraulic cylinder 120 is shown for the embodiment depicted in FIG. 6, any drive means capable of controllably positioning the shaft 100 may be used without changing the scope of the present invention.

Figure 7:
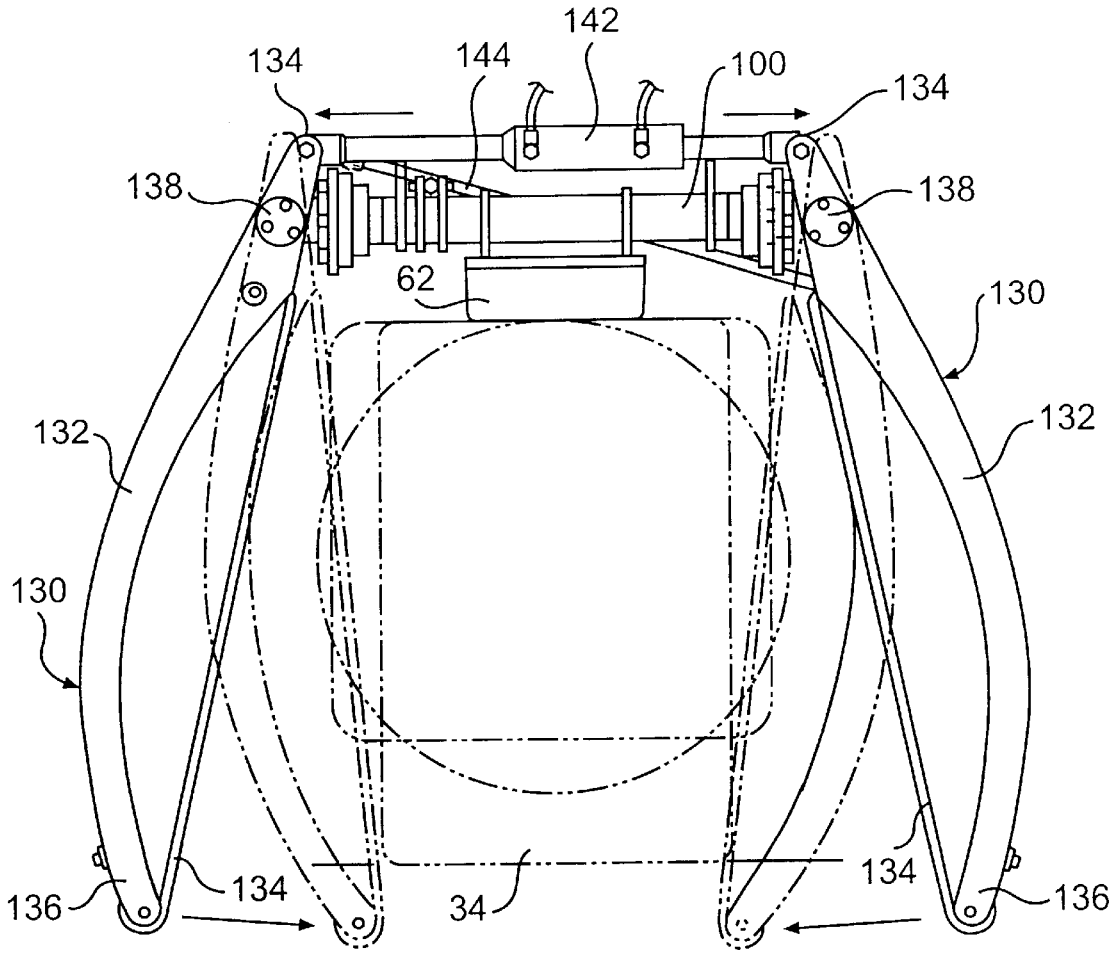
FIG. 7 is a top, partial perspective view, depicting operation of the clamp arms of the self-adapting receptacle lift of FIG. 1.

Referring to FIG. 7, a pair of self-adapting clamp arms 130 are pivotably connected respectively to each end of clamp arm shaft 100. Clamp arms 130 each include an arcuate support member 132 having a first end 134 and a second end 136. Each arm 130 is pivotably connected to shaft 100 at a pivot point 138 located near first end 134 of arcuate support member 132. A band of flexible material 140 is attached to each support member 132. Material 140 is connected to both first end 134 and second end 136 of each support member 132 so as to span between the ends of support member 132. The material 140 may be constructed of any sufficiently flexible materials, including a composite or laminate of different materials. For example, material 140 may include a composite of rubber, vinyl, metal belts, and the like. By utilizing a flexible material, lift 40 adapts to the size and shape of various receptacles 34 (depicted in broken lines in FIG. 7) that may be lifted. More specifically, upon closing self-adapting clamp arms 130, flexible material 140 adapts to the shape of receptacle 34 while maintaining enough rigidity, with reinforcement from support member 132, to secure the receptacle 34 for dumping. The arcuate shape of support member 132 provides room for flexible material 140 to displace and deform so to adapt to a particular receptacle's shape.

Clamp arms 130 are not limited to the shape and construction depicted in FIG. 7. The shape, construction, and operation of the clamp arms 130 may be varied to provide for an adaptable embracing means within the scope of the present invention. By way of example only, support member 132 may assume nonarcuate shapes and flexible material 140 may be attached to support member 132 at locations other than ends 134 and 136. Furthermore, a flexible or resilient material, such as foam or rubber padding, could be attached to the entire length of support member 132 to provide another means by which support member 132 could adapt to the shape of a receptacle 34. Accordingly, the present invention provides a lift 40 adaptable to the shape and size of various containers and is not limited to the particular adapting means disclosed in FIG. 7.

As also show in FIG. 7, a second hydraulic cylinder 142 is pivotably connected to each support member 132 near first ends 134 thereof respectively. Selective extension and contraction of second hydraulic cylinder 142, as shown by the arrows in FIG. 7, controls the pivoting of the clamp arms 130 about pivot points 138 and empowers clamp arms 130 to selectively embrace a receptacle for lifting. As shown in FIG. 5, a connecting rod 144 is pivotably connected at each end respectively to clamp arms 130. While connecting rod 144 is connected near the first end 134 of each support member 132, this pivoting connection is on opposite sides of the pivot points 138, respectively, of each clamp arm 130, as depicted in FIG. 1. During the extension and retraction of second hydraulic cylinder 142, connecting rod 144 ensures that clamp arms 130 open and close in unison as opposed to only moving one clamp arm 130 or moving the clamp arms 130 unevenly. Connecting rod 144 may also be configured such that its length is adjustable, whereby the unclamped width between second ends 136 of clamp arms 130 may be determined. While a hydraulic cylinder 142 is depicted for this embodiment, any drive means for controllably pivoting clamp arms 130 about pivot points 138 may be used within the scope of the present invention.

As shown in FIG. 1 and FIG. 6, the clamp arm shaft 100 also supports bumper 62, which is fixedly attached to shaft 100, and oriented along shaft 100 so as to align with clamp arms 130. Accordingly, upon the controlled rotation of clamp arm shaft 100 using first hydraulic cylinder 120, bumper 62 rotates in alignment with clamp arms 130. Bumper 62 thereby provides additional stabilizing support to receptacle 34 embraced within the clamp arms 130, as shown in FIG. 7. Other means may be used to provide such support to receptacle 34 within the meaning of the present invention. For example, carriage 60 may include a stabilizing means such as a bumper or a flexible rest located upon carriage face 63.

In operation, the power means of lift 40, more specifically actuator 50, first hydraulic cylinder 120, and second hydraulic cylinder 142, may be selectively operated and powered by a variety of hydraulic control systems. For example, each power means could be controlled by single hydraulic valves dedicated respectively to each drive means. Additionally, and by way of example only, each valve may be integrated into a control system for automatically sequencing all valves through a cycle of lifting receptacle 34 and dumping its contents.

The present invention may include a hydraulic control system 148 as depicted in FIG. 8. A dual hand valve 150 is hydraulically connected to a sequencing control valve 152 and a dual check valve 154. In turn, dual check valve 154 is connected to actuator 50 with output shaft 52 having ends 54. First hydraulic cylinder 120 and second hydraulic cylinder 142 are also connected to control valve 152. A supply line 158 supplies hydraulic fluid from a pressurized source, such as a pump, to flow regulator 156, which in turn supplies dual hand valve 150. A return line 160 allows hydraulic fluid to flow from dual hand valve 150 to a reservoir such as a storage tank. Dual hand valve 150 may be mounted at a location accessible to the user, such as the side of a refuse gathering vehicle or a refuse container.

Figure 9:
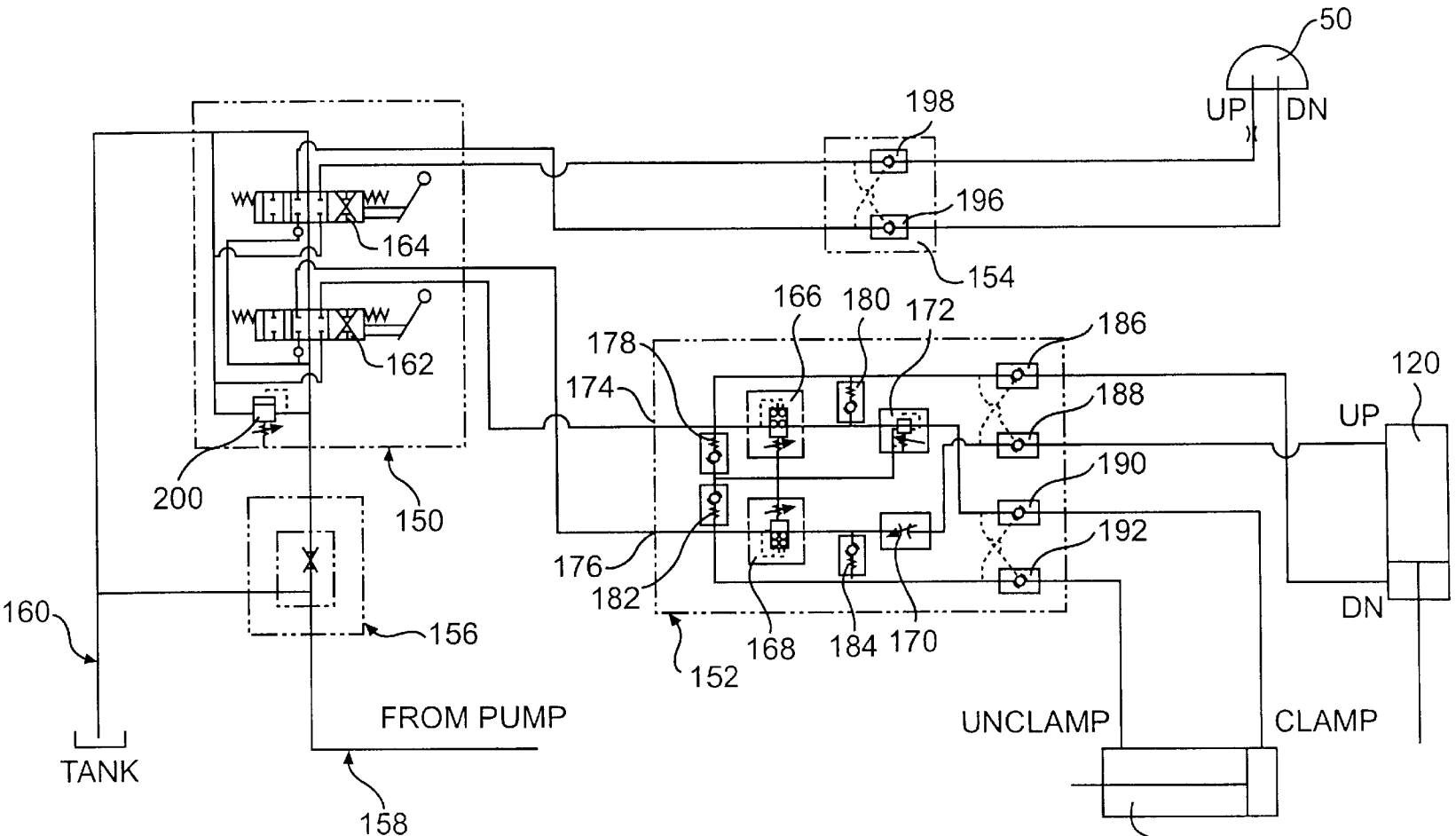
FIG. 9 is a schematic of various features of an exemplary hydraulic control system in accordance with the present invention.

FIG. 9 is a schematic of hydraulic control system 148 using conventional symbols and connection lines understood and used by those having ordinary skill in the art. Hydraulic fluid is supplied from a pressurized source, such as a pump, using supply line 158. Flow regulator 156 maintains a relatively constant outlet flow of fluid to dual hand valve 150. For the particular embodiment of the invention being described, flow regulator 156 may accept an inlet flow of between 2 to 24 gallons per minute with a pressure between 1800 to 3000 pounds per square inch. Under these conditions, flow regulator 156 maintains a relatively constant outlet flow of 2 gallons per minute.

Dual hand valve 150 consists of a first hand valve 162 and a second hand valve 164. Both valves 162 and 164 are three positioned, spring centered, open center directional valves that are used to direct hydraulic fluid to lift 40. Dual hand valve 150 includes a pressure release valve 200 which may be preset at the desired level to protect system components.

From dual hand valve 150, hydraulic fluid may be exchanged with sequencing control valve 152, identified generally by the broken lines in FIG. 9. Sequencing control valve 152 includes the following elements connected as shown diagrammatically in FIG. 9: A pair of sequence valves 166 and 168, a needle valve 170, a pressure reducing valve 172, a pair of ports 174 and 176, four check valves 178, 180, 182, and 184; and four pilot operated check valves 186, 188, 190, and 192. From sequencing control valve 152, fluid is exchanged with first hydraulic cylinder 120 and second hydraulic cylinder 142. The operation of sequencing control valve 152 will be more fully described below.

Dual hand valve 150 also exchanges hydraulic fluid with dual check valve 154, which includes a pair of dual pilot operated check valves 196 and 198. From dual check valve 154, hydraulic fluid is exchanged with actuator 50 as shown.

Therefore, upon supplying a pressurized hydraulic fluid to hydraulic control system 148, first hand valve 162 may be selectively operated to pressurize port 174, so as to direct clamp arms 130 to rotate down from the vertical position shown in FIG. 1 to the horizontal position shown in FIG. 4 by causing first hydraulic cylinder 120 to retract. As the clamp arms 130 reach the horizontal position, sequence valve 166 senses the pressure increase and shifts to direct hydraulic fluid to second hydraulic cylinder 142, causing clamp arms 130 to clamp by extending second hydraulic cylinder 142. Second hand valve 164 may then be selectively operated to raise carriage 60 and its attachments, including clamp arms 130, by powering actuator 50 to as to rotate output shaft 52, thereby lifting torque arms 78, which rotate with output shaft 52. Consequently, a receptacle held between clamp arms 130 may be raised, inverted, and projected so as to dump the contents of the receptacle through movements previously described.

After emptying the contents of the receptacle, second hand valve 164 may then be selectively operated so as to cause output shaft 52 of actuator 50 to rotate in the opposite direction, therefore reversing the direction of travel of torque arms 78 so as to lower carriage 60 and its attachments including clamp arms 130. In this way, a receptacle within clamp arms 130 may be returned to a relatively lowered position. Next, first hand valve 162 may be selectively operated so as to pressurize port 176 of sequencing control valve 152. Pressurizing port 176 causes clamp arms 130 to unclamp by retracting second hydraulic cylinder 142. As clamp arms 130 reach the fully unclamped position, sequence valve 168 senses the pressure increase and shifts to direct hydraulic fluid to first hydraulic cylinder 120, causing clamp arms 130 to return to the vertical position of FIG. 1 by extending first hydraulic cylinder 120.

During all operations of the sequencing control valves 152 just described, a pressure reducing valve 172 operates to control the clamping pressure applied by clamp arms 130. A needle valve 172 operates to control the speed of movement of clamp arms 130. The pilot operated check valves, 186, 188, 190, 192, 196, and 198, operate to prevent unwanted movement of clamp arms 130. Dual check valve 154 also prevents lifter 40 from moving in the event of a hydraulic line failure.

For the embodiment depicted in FIG. 1, containers having volumes as small as 30 gallons to as large as 95 gallons may be dumped using lift 40. Additionally, receptacles and contents weighing up to 300 pounds, preferably up to 200 pounds, may be lifted with the present invention. This is provided by way of example only. The scale of the invention may be modified to achieve other specifications within the scope of the present invention. It is also to be understood that although receptacle 34 has been used in describing an embodiment, the present invention is not limited to use with a receptacle of the same or similar shape and size as receptacle 34. More specifically, receptacle 34 is depicted by way of example only.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

What is claimed is:

1. A self-adapting refuse receptacle lift apparatus comprising:

a support frame;

a hydraulic actuator, attached to said support frame, having a rotatable output shaft, and configured for controllably positioning the rotary orientation of said output shaft;

a carriage adapted for supporting a receptacle, said carriage being pivotally supported relative to said support frame;

a plurality of arms for supporting said carriage relative to said support frame and relative to said rotatably support shaft;

a clamp arm shaft attached to said carriage and rotatable relative to said carriage;

a pair of self-adapting clamp arms, each clamp arm having a receptacle receiving end and a non-receptacle receiving end, each clamp arm being pivotally connected near the non-receptacle receiving end to said rotatable clamp arm shaft, whereby said clamp arms may be controllably rotated relative to said carriage, each of said clamp arms being configured to adapt to the size and shape of a variety of receptacles for lifting by said apparatus;

a first hydraulic drive affixed to said carriage and pivotally connected to said rotatable clamp arm shaft, wherein said first hydraulic drive may controllably position the rotary orientation of the clamp arm shaft;

a second hydraulic drive pivotally connected to said non-receptacle receiving end of said pair of self-adapting clamp arms, whereby said clamp arms may be controllably opened and closed; and a connecting rod connected to said non-receptacle receiving end of said pair of self-adapting clamp arms on opposing sides of said pivotal connection with said second hydraulic drive to ensure coordinated opening and closing of said self-adapting clamp arms;

wherein said hydraulic actuator, said first hydraulic drive, and said second hydraulic drive are controllably operated so as to cause in sequence controlled rotation of the self-adapting clamp arms from an upright stored position to a position for the receipt of a receptacle, controlled closing of the self-adapting clamp arms for securing a receptacle, and controlled pivoting of the carriage on respective ends of said plurality of arms, from a lowered, upright position of said carriage for receiving a receptacle to a relatively raised, inverted position of said carriage for emptying the contents of a receptacle.

2. A self-adapting refuse receptacle lift apparatus as in claim 1, wherein said plurality of arms includes a pair of idler arms for pivotally supporting said carriage relative to said support frame.

3. A self-adapting refuse receptacle lift apparatus as in claim 2, wherein said plurality of arms further includes a pair of torque arms for pivotally supporting said carriage relative to said rotatable output shaft.

4. A self-adapting refuse receptacle lift apparatus as in claim 1, wherein each of said pair of self-adapting clamp arms are arcuate.

5. A self-adapting refuse receptacle lift apparatus as in claim 1, wherein said self-adapting clamp arms further comprise a band of flexible material connected near said receptacle-receiving end and near said non-receptacle receiving end of said self-adapting clamp arms and spanning in between said ends, whereby upon contacting a receptacle, said clamp arms may adapt to the size and shape of said receptacle for securing said receptacle during lifting and dumping of the receptacle.

6. A self-adapting refuse receptacle lift apparatus as in claim 5, wherein said band of flexible material is one of the group comprising: foam padding, rubber padding, a rubber belt, a vinyl belt, a metal belt, or a composite of rubber or vinyl.

7. A self-adapting refuse receptacle lift apparatus as in claim 1, wherein said first hydraulic drive further comprises a reciprocating shaft.

8. A self-adapting refuse receptacle lift apparatus comprising:

a base adapted for mounting said lift onto a container;

a first power means, attached to said base, having a rotatable output shaft, said first power means controllably positioning the rotary orientation of said output shaft;

a carriage pivotally supported relative to said base;

dual paired projection arm means, pivotally associated with said base and said output shaft, respectively, for supporting and selectively positioning said carriage during the lifting and conveying of a receptacle, and configured so as to dump the contents of a receptacle received by said lift into said container;

a positioning shaft, connected to and rotatable relative to said carriage;

an adaptable embracing means for receipt of a receptacle, pivotally connected to said positioning shaft such that the rotary orientation of said embracing means may be controlled by said positioning shaft, and adaptable to the size and shape of a receptacle to be lifted;

a support means, connected to said positioning shaft, for providing support to a receptacle received by said lift;

a second power means, attached to said carriage, and pivotally attached to said positioning shaft, whereby said second power means may control the rotary orientation of said positioning shaft;

a third power means, connected to said adaptable embracing means and controllably pivoting said embracing means about said positioning shaft such that a receptacle may be controllably embraced;

a connecting rod connected to said adaptable embracing means on opposing sides of said pivotal connection with said positioning shaft to ensure coordinated opening and closing of said adaptable embracing means;

wherein selective operation of said first, second, and third power means causes in sequence controlled rotation of said adaptable embracing means from an upright stored position to a position for the receipt of a receptacle, controllable embracing of a receptacle by said embracing means, and controlled movement of said carriage on said dual paired projection arm means relative to said base from a lowered position of said embracing means for receipt of a receptacle to a relatively raised, and inverted position for the emptying of any contents within the receptacle into said container.

9. A self-adapting refuse receptacle lift apparatus as in claim 8, wherein said adaptable embracing means are arcuate.

10. A self-adapting refuse receptacle lift apparatus as in claim 8, wherein said adaptable embracing means comprise a pair of arms with a band of flexible material connected at each end of said arms and stretched between said ends, whereby upon contacting a receptacle, said flexible material may adapt to the size and shape of said receptacle for securing said receptacle between said adaptable embracing means during lifting and dumping of the receptacle.

11. A self-adapting refuse receptacle lift apparatus as in claim 10, wherein said band of flexible material is one of the group comprising: foam padding, rubber padding, a rubber belt, a vinyl belt, a metal belt, or a composite of rubber or vinyl.

12. A self-adapting refuse receptacle lift mounted on a refuse collection vehicle comprising:

a mainframe having a first side and a second side, said first side being adapted for attachment to said vehicle;

a motor, attached to said second side of said mainframe, having a rotatable output shaft, and configured for controllably positioning the rotary orientation of said output shaft;

a plate pivotally connected to said second side of said mainframe;

a first pair of arms, pivotally connected to said second side of said mainframe and pivotally connected to said plate;

a second pair of arms, fixedly connected to said rotatable output shaft and pivotally connected to said plate;

a clamp arm shaft secured to said plate and rotatable relative to said plate;

at least one clamp arm, said clamp arm including an arcuate support member having a first end and a second end, said support member pivotally connected near said first end to said clamp arm shaft such that the rotary orientation of said clamp arm may be controlled by said clamp arm shaft, said clamp arm also including a band of flexible materials connected near said first end and near said second end of said support member and spanning in between said ends, whereby upon contacting a receptacle, said clamp arm may adapt to the size and shape of said receptacle for securing said receptacle during lifting and dumping of said receptacle;

a first hydraulic cylinder attached to said plate and pivotally attached to said clamp arm shaft and configured such that the extension and retraction of said first hydraulic cylinder controls the rotary orientation of said clamp arm shaft;

a second hydraulic cylinder pivotally connected near said first end of said clamp arm and configured such that the extension and retraction of said second hydraulic cylinder controls the pivoting of said clamp arm about said clamp arm shaft, whereby said clamp arm may be pressed against said receptacle to secure said receptacle to said lift;

a connecting rod connected to said at least one clamp arm on opposing sides of said pivotal connection with said clamp arm shaft to ensure coordinated opening and closing of said adaptable embracing means;

wherein selected operation of said motor, said first hydraulic cylinder, and said second hydraulic cylinder causes in sequence said clamp arm to move from an upright stored position to a position for the receipt of a receptacle into a position so as to secure a receptacle to said lift; and causes said lift to move said receptacle from a relatively lowered position to a relatively upright and inverted position where the contents may be dumped into said vehicle.

13. A self-adapting refuse receptacle lift mounted on a refuse collection vehicle as in claim 12, wherein said band of flexible material is one of the group comprising: foam padding, rubber padding, a rubber belt, a vinyl belt, a metal belt, or a composite of rubber or vinyl.

* * * * *